US006474805B2

(12) United States Patent
Dante et al.

(10) Patent No.: US 6,474,805 B2
(45) Date of Patent: Nov. 5, 2002

(54) PRINTER AND TRANSPORT ASSEMBLY

(75) Inventors: Henry M. Dante, Midlothian, VA (US); Georgios D. Karles, Richmond, VA (US); Barry S. Smith, Hopewell, VA (US); Freddie L. Ford, Midlothian, VA (US); Xuan M. Pham, Glen Allen, VA (US)

(73) Assignee: Philip Morris Incorporated, New York, NY (US)

( * ) Notice: Subject to any disclaimer, the term of this patent is extended or adjusted under 35 U.S.C. 154(b) by 0 days.

(21) Appl. No.: 09/916,361

(22) Filed: Jul. 27, 2001

(65) Prior Publication Data

US 2002/0012036 A1 Jan. 31, 2002

Related U.S. Application Data

(60) Provisional application No. 60/221,446, filed on Jul. 28, 2000.

(51) Int. Cl.[7] ..... B41J 2/01

(52) U.S. Cl. ..... 347/102; 347/104

(58) Field of Search ..... 347/2, 4, 102, 347/104; 399/382, 397–400; 400/625, 708

(56) References Cited

U.S. PATENT DOCUMENTS 5,839,045 A * 11/1998 Wierszewski ..... 399/382
6,048,060 A * 4/2000 Narushima et al. ..... 347/104

* cited by examiner

*Primary Examiner*—John Barlow
*Assistant Examiner*—An H. Do
(74) *Attorney, Agent, or Firm*—Connolly Bove Lodge & Hutz LLP

(57) ABSTRACT

A printer and transport assembly includes a transport conveyor for receiving individual blanks and continuously conveying the blanks in a downstream direction. A digital high speed printer is positioned directly above the transport conveyor downstream from where the blanks are received on the transport conveyor for printing high quality indicia on the individual blanks as they are continuously conveyed downstream. A blank drying arrangement receives printed blanks from the transport conveyor and moves the blanks in spaced relationship over a course of travel of sufficient length so as to sufficiently dry the printed indicia on the blanks. Ultimately, the dried printed blanks may be collected in a stack. Packaging, greeting cards, stickers, labels and coupons, for example, may be printed with the printer and transport assembly.

19 Claims, 1 Drawing Sheet

PRINTER AND TRANSPORT ASSEMBLY

REFERENCE TO RELATED APPLICATION

This application claims the benefit of provisional application Ser. No. 60/221,446, filed Jul. 28, 2000, which is incorporated herein by reference in its entirety for all useful purposes.

BACKGROUND OF THE INVENTION

The present invention relates to printing, and more particularly to a high speed, high quality printer and transport assembly.

In the past, there have been applications of ink jet technology in packaging, especially for low resolution applications like case coding, bar coding and the like, with a continuous ink jet being the main technology of choice. Ink jet technology, through recent advances, has reached a stage where it can now be used to develop printing systems for applications in total package printing.

Ink jet technology has become increasingly popular in different printing applications including small home office printing, textile printing, as well as some customized printing applications, like mailing labels, etc. The next logical application for this technology is in industrial packaging for consumer products and the like. The application of digital technology, in particular ink jet technology to consumer packaging offers new ways to customize the packaging and product promotions and marketing. Ink jet technology is ideally suited for application in this area provided it meets the quality and the throughput requirements of this application. Though there have been attempts in the past to use this technology for packaging applications, it is only the recent advances in technology developments that have made it possible to meet the demands of some of these applications.

Among the two types of ink jet technologies, i.e., continuous ink jet (CIJ) and drop on demand ink jet (DOD), the CIJ technology has had some success in applications relating to industrial high speed printing like date and bar coding, and personalized mailing systems. Of late, the DOD technology has made inroads into some of these application areas. There are many advantages of using the DOD technology including simplicity, affordable cost, reliability, more ink formulation options and the possibility of getting high quality printing. Some of the issues that need to be addressed are drying times, water and abrasion resistance, reliability and speed.

Current packaging systems utilize preprinted materials which come in either as large label rolls (used in packages known as soft packs), or as blanks (used in packages known as hard packs) in units of a few hundred. The feeding mechanism depends upon whether label rolls or blanks are used. Large amounts (typically hundreds of thousands or millions) are printed using traditional printing techniques. When the volumes are large and if the printed information on the packages does not vary, the traditional printing is very cost effective. When the production schedule is fixed in advance, the system works quite well. But in practice, the changes in supply and demand mean that it is seldom that a production schedule is fixed in advance. Last minute changes are a rule rather than an exception, and as a result, a large amount of buffer stock of the packaging material must be maintained to accommodate these changes as and when they occur. So in consumer packaging industries, it is common to have huge warehouses filled with the preprinted packaging materials. Such storage will mean inventory maintenance and tracking as well as significant waste due to excess materials and obsolescence in graphics or materials due to aging.

SUMMARY OF THE INVENTION

Accordingly, one of the objects of the present invention is a printer and transport assembly which is simple in construction but which produces high quality printed blanks at high production speeds .

Another object of the present invention is a method of printing blanks by digitally printing high quality indicia on the blanks at high production speeds.

Another object of the present invention is a method of printing package blanks on line during the packaging operation.

Another object of the present invention is a method of printing variable information on the blanks at high production speeds.

Another object of the present invention is a method of package printing at high production speeds with a modular package printing system comprising a print engine, transport mechanism, drying mechanism, inspection system and a restacker which works as a buffer.

Another object of the present invention is a method of printing at production speeds which incorporates a drying tower to provide sufficient drying time for the printed blanks.

Another object of the present invention is a method of package printing at production speeds with the system providing a buffer of printed blanks during an online printing operation which decouples the printing operation from the packer so that when the printer is stopped for a short period (e.g. for clearing a jam), the packer continues to run.

Still another object of the present invention is a method of package printing at production speeds to print variable information on either side of a blank.

Another object of the present invention is a method of printing variable information on partially printed blanks at production speeds where the partially printed blanks are printed using conventional printing techniques such as Gravure or offset, for example.

Another object of the present invention is a method of printing at production speeds where variable information is printed at any preselected location on the blank in any orientation and where the location and/or orientation may be changed for each individual blank.

Yet another object of the present invention is a method of printing at production speeds which incorporates an optical inspection mechanism to verify the quality and integrity of the printing.

In accordance with the present invention, a printer and transport assembly comprises a transport conveyor for receiving individual blanks and continuously conveying the blanks in a downstream direction. A digital high speed printer directly above the transport conveyor downstream from where the blanks are received on the transport conveyor prints high quality indicia on the individual blanks as the blanks are continuously moved downstream by the conveyor. A blank drying arrangement receives printed blanks from the transport conveyor and conveys those blanks in spaced apart relationship over a course of travel of sufficient length so as to sufficiently dry the printed indicia on the blanks. The printed and dried blanks are then collected in a stack, for example, for subsequent use such as in packaging applications, for example. Greeting cards, stickers, labels, coupons and the like may also be printed with the printer and transport assembly of the present invention.

The printer and transport assembly may also include a dryer directly above the transport conveyor immediately downstream from the digital high speed printer for initially partially drying printed blanks. Also, an inspection unit may be positioned directly above the transport conveyor downstream from the dryer for inspecting printed blanks and removing any printed blank below a predetermined printing standard.

Blank supply structure may be positioned upstream of the digital high speed printer for holding and delivering individual blanks from a vertical stack to the transport conveyer, and a suction arrangement may be provided for removing a lowermost blank in the stack and depositing that blank on the transport conveyor.

Moreover, the transport conveyor may include the combination of a first horizontally oriented moving belt arrangement for receiving blanks from the blank supply structure, and a second horizontally oriented moving belt arrangement downstream from the first for receiving blanks from the first belt arrangement. Preferably, a suction manifold is positioned directly below the second moving belt arrangement with perforations on an upper surface of the manifold. Perforations are also positioned in the second belt arrangement so that suction from the manifold is applied thereto to vacuum hold blanks on the second belt arrangement as the blanks are printed and transported downstream to the drying arrangement.

Preferably, the digital high speed printer includes a mounting that initially moves the printer transversely relative to the transport conveyor to a predetermined position prior to printing of the blanks.

The blank drying arrangement may comprise a variety of configurations including a drying tower in the form of a vertically oriented drying conveyor having spaced apart dryer shelves for receiving printing blanks from the transport conveyor, with one printed blank on each shelf. A transfer conveyor may be positioned between the drying arrangement and the collection point for receiving printed blanks from the shelves of the drying conveyor and delivering the blanks to the collection point.

The present invention also includes a method of printing package blanks that comprises a series of operative steps utilizing the above described components of the printer and transport assembly.

BRIEF DESCRIPTION OF THE DRAWINGS

Novel features and advantages of the present invention in addition to those noted above will become apparent from a reading of the following detailed description in conjunction with the accompanying drawings wherein similar reference characters refer to similar parts and in which.

DETAILED DESCRIPTION OF THE INVENTION

Figures 1, 2:
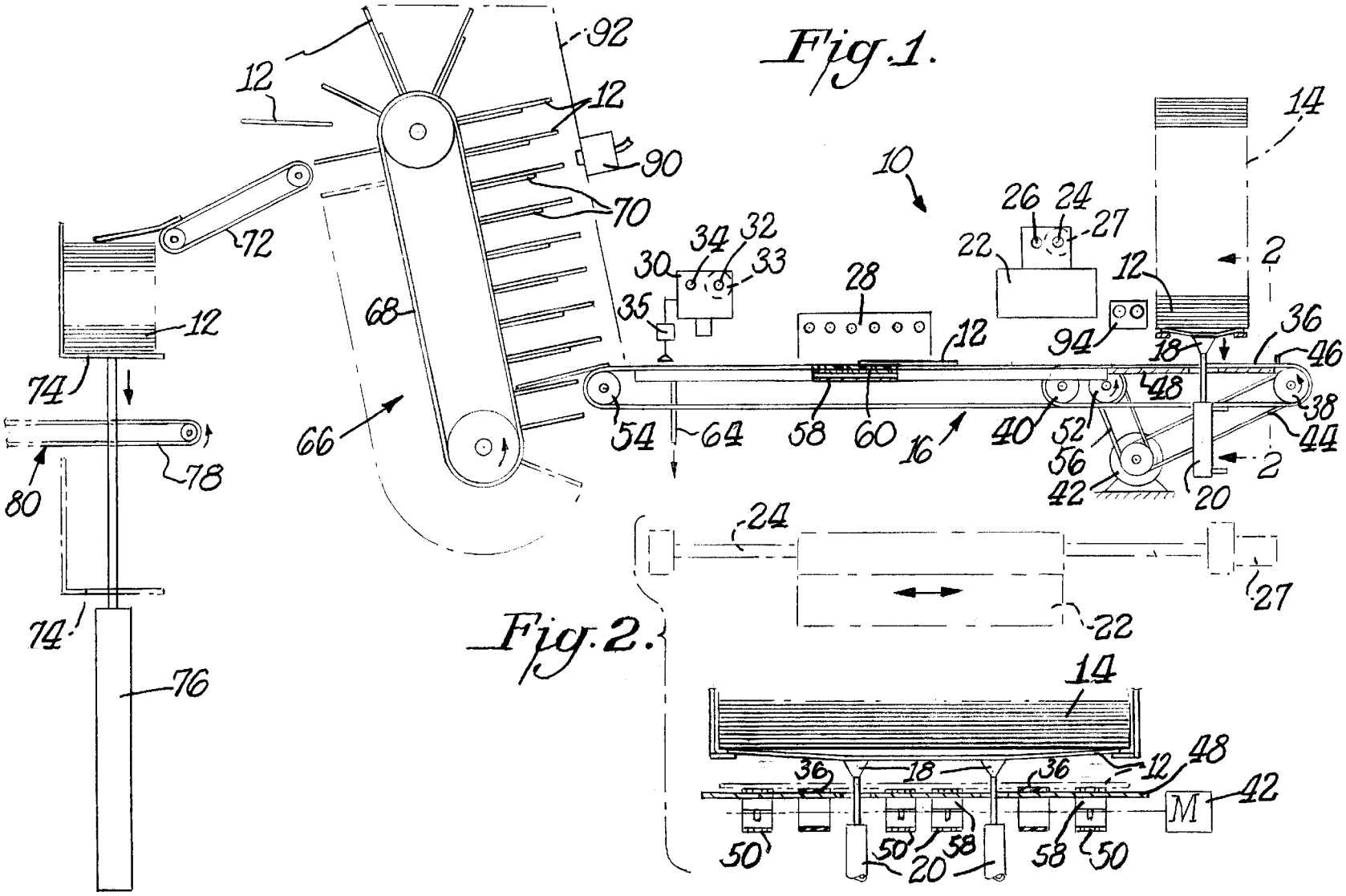
FIG. 1 is a schematic side elevational view of a digital package printer and transport assembly including an ink drying conveyor arrangement, according to the present invention.
FIG. 2 is a cross-sectional view in elevation taken along line 2—2 of FIG. 1.

Referring in more particularity to the drawings, FIG. 1 diagrammatically illustrates a package printer and transport assembly 10 for digitally printing package blanks 12 with high quality printing indicia. Although package blanks are described in detail, a variety of different blanks may be used including blanks for greeting cards, stickers, labels, coupons, and the like. Assembly 10 includes a vertical stack 14 of package blanks 12 and a transport system 16 for receiving individual package blanks 12 from the vertical stack 14 and continuously conveying the blanks in a downstream direction. Vacuum suction cups 18 are connected to a piston and cylinder 20 for vertical movement. The cups 18 function to remove a lowermost blank in the stack 14 and to deposit that blank on the transport system 16.

A digital high speed printer 22 is positioned directly above the transport system 16 downstream from the supply stack 14 of packaging blanks 12. Printer 22 functions to print high quality indicia on the individual blanks as the blanks are continuously conveyed downstream by the transport system 16. The digital printer 22 is mounted on a transverse drive screw 24 and a transverse guide rod 26 for transverse movement relative to the direction of travel of the transport system 16. The drive screw is driven by motor 27, and in operation, the digital printer 22 is initially moved to a predetermined position prior to actual printing of the blanks. Printing then occurs.

The printing may be done on line during a packaging operation, and variable information may be printed on the blanks at high production speeds. Also, drive screw 24 may be programed to initially change the position of the printer for different sets of individual blanks prior to printing the sets.

A dryer 28 is positioned directly above the transport system 16 immediately downstream from the digital high speed printer 22 for initially partially drying printed packaging blanks. Dryer 28 may simply direct heated air onto the printed blanks to initially partially dry the indicia.

Additionally, an inspection unit 30 is positioned directly above the transport system 16 downstream from the dryer 28 for inspecting printed blanks and removing any blanks below a predetermined printing standard. The inspection unit is also mounted for transverse movement by a motor driven transverse drive screw 32 and a transverse guide rod 34. Motor 33 powers the drive screw. In operation, the inspection unit 30 is initially moved to a predetermined position prior to actual inspection, and when so positioned an optical inspection may be made to inspect the quality of the printed blanks. Any blanks found to be below a predetermined printing standard are removed by the suction cups 35.

Basically the transport system 16 includes a pair of first horizontally oriented belts 36 for receiving individual blanks 12 from the vertical stack 14. Belts 36 are spaced apart, as shown best in FIG. 2, and the belts are trained around a driven pulley 38 and an idler pulley 40. A drive motor 42 is connected to driven pulley 38 by a drive belt 44. Operation of drive motor 42 drives the first pair of belts 36 in a downstream direction as shown. The spacing between the first pair of belts 36 allows the vacuum suction cups 18 to move up and down therebetween in order to deposit the lowermost package blank 12 in vertical stack 14 upon the belts 36. Both belts 36 may include spaced apart pusher elements 46 that engage the individual blanks and move them in a downstream direction. The belts 36 rest on a stationary support table 48.

The transport system 16 also includes a second plurality of horizontally oriented belts 50 that receive package blanks from the first belts 36 for conveying the blanks in the downstream direction. Belts 50 are trained around a driven pulley 52 and an idler pulley 54. The drive motor 42 is connected to driven pulley 52 by a drive belt 56. The arrangement of transport system 16 is such that all the belts 36, 50 move in a downstream direction at the same speed.

A suction manifold 58 is mounted directly below the plurality of second belts 50 for applying a suction to the underside of these belts. The suction manifold includes perforations 60 in the upper surface of the manifold, and perforations are also provided in each of the second belts 50. In operation, suction from manifold 58 is applied to the plurality of second belts 50 to vacuum hold the package blanks 12 on the second belts as the blanks are printed, initially partially dried, inspected, and transported downstream. A suction supply 64 is connected to manifold 58 as shown.

The package printer and transport assembly 10 also includes a package blank drying arrangement 66 in the form of a drying tower that includes a dryer conveyer 68 for receiving printed blanks from the transport system and conveying the blanks in spaced apart relationship over a course of travel of sufficient length so as to sufficiently dry the printed indicia on the blanks prior to restacking. Conveyor 68 is vertically oriented and includes a plurality of spaced apart dryer shelves 70 for receiving printed blanks from the transport system 16, with one printed blank on each shelf. The printed blanks are elevated and later removed for transport to a collection point.

Sufficient drying may include complete drying or drying to a point that smearing or print transfer to an adjacent blank does not occur. The degree of drying depends on ink and substrate characteristics and on when and how the printed blanks are subsequently processed. If such processing is immediate a higher degree of drying may be necessary particularly when compared to those instances where the printed blanks are not immediately processed.

As shown in FIG. 1, the dried printed package blanks are removed from the dryer conveyor 68 and deposited upon a transfer conveyor 72 which in turn places the blanks on a stacker tray 74. The tray 74 is connected for vertical movement by a piston and cylinder 76. When the stacker tray collects a predetermined number of package blanks the tray is further lowered between spaced apart belts 78 of a stack removal conveyer 80. The stack of blanks is then removed by conveyer 80.

Although the speed and resolution requirements vary greatly depending upon the product and package in question, a general range of requirements is as follows: Product speed ranging from a few tens to several hundreds blanks per minute, the most common speeds being 100–300 blanks per minute. Resolution that is normally required ranges from 200 dpi to 600 dpi with good abrasion and water resistance as well as fade resistance. Pigmented inks are used to meet these requirements. Moreover, the package printer and transport assembly 10 may be directly appended to packaging machinery, and it is therefore important that the assembly 10 meet the quality and the speed requirements of the product line. Drying time for the ink as well as any residual solvent retention which may not be acceptable are also very important, and the package blank drying arrangement 66 meets that demand.

Included among the beneficial characteristics of the printer and transport assembly 10 is that the individual components may be modular whereby change and/or adjustment is easily accomplished. The assembly may as used alone or integrated into consumer product packing units. Moreover, the assembly is removable and may serve multiple packing units. It is extremely flexible, and may be customized to accommodate different applications. The entire blank may be printed with or without variable information, and printing may be different from blank-to-blank. Location of variable information on the blank is easily controlled.

Different types of print ink and colors may be simultaneously used, and the blanks may comprise a variety of substrates such as paper, plastic and ceramic, for example, all in precut form. Multiple print heads may be used.

The printer and transport assembly 10 may be loosely coupled to the packing process to accommodate throughput variabilities for the printer and the packing unit. Moreover, the assembly may be utilized to provide a buffer of printed blanks to the packing unit.

The dwell time in the drying arrangement 66 may be adjusted by changing the size of the arrangement, and the arrangement may also include a source of additional air flow 90, heated or not, with or without a partial or substantially complete enclosure 92 to aid in the drying process. Also, in some instances it may be desirable to heat the blanks prior to printing such as by directing heat from heater 94 onto the blanks.

We claim:

1. A printer and transport assembly comprising:

transport means for receiving individual blanks and continuously conveying the blanks in a downstream direction;

a digital high speed printer directly above the transport means downstream from where the blanks are received on the transport means for printing indicia on the individual blanks as the blanks are continuously conveyed downstream by the transport means;

a blank drying arrangement for receiving printed blanks from the transport means and conveying the printed blanks in spaced apart relationship over a course of travel of sufficient length so as to substantially dry printed indicia on the blanks; and collection means for receiving package blanks from the drying arrangement.

2. A printer and transport assembly as in claim 1 including:

a dryer directly above the transport means immediately downstream from the digital high speed printer for initially partially drying printed blanks.

3. A printer and transport assembly as in claim 2 including:

an inspection unit directly above the transport means downstream from the dryer for inspecting printed blanks and removing any printed blanks below a predetermined printing standard.

4. A printer and transport assembly as in claim 1 including:

blank supply means upstream of the digital high speed printer constructed and arranged to hold and deliver individual blanks from a vertical stack of blanks to the transport means.

5. A printer and transport assembly as in claim 4 including:

suction means for removing a lowermost blank in the stack and depositing that blank on the transport means.

6. A printer and transport assembly as in claim 1 wherein the transport means includes:

first horizontally oriented moving belt means for receiving blanks; and second horizontally oriented moving belt means downstream from the first belt means for receiving blanks from the first belt means.

7. A printer and transport assembly as in claim 6 including:

a suction manifold directly below the second belt means including perforations in an upper surface of the manifold; and perforations in the second belt means whereby suction from the manifold is applied to the second belt means to vacuum hold the blanks on the second belt means as the blanks are printed and transported downstream to the drying arrangement.

8. A printer and transport assembly as in claim 1 wherein the digital high speed printer includes:

a mounting constructed and arranged to move the printer back and forth transversely relative to the transport means to a predetermined position prior to printing of the blanks.

9. A package printer and transport assembly as in claim 1 wherein the blank drying arrangement includes:

a vertically oriented drying conveyor having spaced apart dryer shelves for receiving printed blanks from the transport means with one printed blank on each shelf.

10. A printer and transport assembly as in claim 9 including:

a transfer conveyor between the drying arrangement and the collection means for receiving printed blanks from the shelves of the drying conveyor and delivering the blanks to the collection means.

11. A printer and transport assembly as in claim 1 wherein the collection means comprises a stacker for collecting printed blanks in a vertical stack.

12. A printer and transport assembly as in claim 1 including:

a heater directly above the transport means upstream from the digital high speed printer for heating the blanks prior to printing.

13. A printer and transport assembly as in claim 1 wherein the blank drying arrangement includes:

a source of air flow directed onto the printed blanks to assist drying thereof.

14. A method of printing blanks comprising the steps of:

providing a supply of blanks;

removing individual blanks from the supply and serially conveying the blanks in a downstream direction;

digitally printing high quality indicia on the blanks as the blanks are conveyed downstream;

conveying printed blanks in spaced apart relationship from one another over a course of travel of sufficient length so as to sufficiently dry the blanks; and collecting the printed blanks.

15. A method of printing blanks as in claim 14 further including the step of:

initially partially drying the printed blanks immediately downstream from digitally printing high quality indicia on the blanks.

16. A method of printing blank as in claim 14 further including the step of:

inspecting printed blanks after initial partial drying of the blanks; and removing any printed blanks below a predetermined printing standard.

17. A method of printing blanks as in claim 14 wherein the step of conveying printed blanks in spaced apart relationship from one another over a course of travel of sufficient length so as to sufficiently dry the blanks includes:

depositing each printed blank on an individual dryer shelf.

18. A method of printing blanks as in claim 14 including the step of:

heating the blanks prior to printing.

19. A method of printing blanks as in claim 14 including the step of:

directing air onto the printed blanks while conveying printed blanks in spaced apart relationship from one another over a course of travel of sufficient length so as to sufficiently dry the blanks.

* * * * *